US006378402B1

(12) United States Patent
Kalomeris et al.

(10) Patent No.: US 6,378,402 B1
(45) Date of Patent: Apr. 30, 2002

(54) HAND TOOL

(75) Inventors: Charles E. Kalomeris, Shrewsbury, PA (US); Jason D. Morris, Abingdon, MD (US); Frank Sterpka; Paul Metaxatos, both of West Hartford, CT (US); David C. Boyle, Severna Park, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/630,296

(22) Filed: Aug. 1, 2000

Related U.S. Application Data

(60) Provisional application No. 60/185,775, filed on Feb. 29, 2000.

(51) Int. Cl.[7] ..... B25B 23/16

(52) U.S. Cl. ..... 81/177.5; 81/177.4; 81/490

(58) Field of Search ..... 7/138, 166; 81/177.4, 81/177.5, 437, 438, 490, 489

(56) References Cited

U.S. PATENT DOCUMENTS

| | | | | |
|---|---|---|---|---|
| 871,155 A | | 11/1907 | Wood | |
| 1,000,900 A | | 8/1911 | Dorsey | |
| 1,371,350 A | | 3/1921 | Campbell | |
| 1,421,792 A | | 7/1922 | Linden | |
| 1,469,792 A | | 10/1923 | Johnson | |
| 1,578,114 A | * | 3/1926 | Fegley | 81/177.5 |
| 1,579,498 A | | 4/1926 | Anderson | |
| 1,683,384 A | * | 9/1928 | Durham et al. | 81/177.5 |
| 1,965,917 A | | 7/1934 | Anderholm | |
| 2,253,905 A | | 8/1941 | Knobel | |
| 2,549,910 A | * | 4/1951 | Lane | 81/177.5 |
| 2,571,570 A | * | 10/1951 | Hagar | 81/177.5 |
| 2,593,828 A | | 4/1952 | Arey | |
| 2,621,688 A | | 12/1952 | Wales | |
| 2,641,291 A | | 6/1953 | Yess | |
| 2,656,865 A | | 10/1953 | Bright | |
| 2,681,378 A | | 6/1954 | Skwarek | |
| 2,719,042 A | * | 9/1955 | Espy | 81/438 |
| 2,825,374 A | | 3/1958 | Reid | |
| 2,870,809 A | | 1/1959 | Feldman | |
| 3,114,401 A | | 12/1963 | Johnson | |
| 3,161,093 A | | 12/1964 | Hoag | |
| 3,416,395 A | | 12/1968 | Hanson | |
| 3,672,419 A | | 6/1972 | Fischer | |
| 3,850,056 A | | 11/1974 | Allen | |
| 3,935,762 A | | 2/1976 | Tudisco | |

(List continued on next page.)

FOREIGN PATENT DOCUMENTS

| | | |
|---|---|---|
| DE | 657438 | 2/1938 |
| DE | G8200018.2 | 7/1982 |
| DE | 3144901 C2 | 5/1983 |
| DE | 4207337 C1 | 6/1993 |
| DE | G9202275.8 | 6/1993 |
| DE | 29516148 U1 | 12/1995 |
| DE | 29615418 U1 | 10/1996 |
| DE | 29618304 U1 | 12/1996 |
| DE | 29701799 U1 | 4/1997 |
| EP | 0579220 B1 | 1/1994 |
| EP | 0627974 B1 | 11/1995 |
| EP | 0744251 A2 | 11/1996 |

*Primary Examiner*—James G. Smith
(74) *Attorney, Agent, or Firm*—Harness, Dickey & Pierce, P.L.C.

(57) ABSTRACT

The present invention is generally directed to a hand held tool having a handle chassis with a first end, a second end, and a bore extending axially between the first and second ends. A sleeve having a first end, a second end, as well as a drive aperture extending from the first sleeve end toward the second sleeve end is disposed in the bore and fixed to the handle chassis. The sleeve also has a storage cavity that extends from the second sleeve toward the first sleeve end and a corridor extending transverse to the storage cavity. A torque bar is connectable to the sleeve in an operative position disposed in the corridor and a stowed position disposed in the storage cavity.

26 Claims, 7 Drawing Sheets

U.S. PATENT DOCUMENTS 3,990,013 A 11/1976 Badger
4,056,020 A 11/1977 Coviello
4,096,896 A 6/1978 Engel
4,125,913 A 11/1978 Lewis
4,235,269 A 11/1980 Kraus
4,535,658 A 8/1985 Molinari
4,542,667 A 9/1985 Jang
4,566,357 A 1/1986 Carossino
4,573,839 A 3/1986 Finnegan
4,640,155 A 2/1987 Condon
4,779,493 A 10/1988 White
4,796,319 A 1/1989 Taft
4,827,812 A 5/1989 Markovetz
4,924,733 A 5/1990 McKenzie
4,926,721 A 5/1990 Hsiao
4,934,221 A 6/1990 Hsiao
4,960,016 A 10/1990 Seals
5,058,465 A 10/1991 Womack
5,063,796 A 11/1991 Gennep
5,222,848 A 6/1993 Kuang-Wu
5,259,277 A 11/1993 Zurbuchen
5,265,504 A 11/1993 Fruhm
5,285,543 A 2/1994 Rowe
5,335,409 A 8/1994 Elvebak
5,337,637 A 8/1994 Bih-Lien
5,341,705 A 8/1994 Lin
5,470,180 A 11/1995 Jore
5,524,513 A 6/1996 Barahona
5,526,723 A 6/1996 Sormunen et al.
5,528,963 A 6/1996 Wei
5,528,966 A 6/1996 Coppejans
5,577,426 A 11/1996 Eggert et al.
5,579,668 A 12/1996 Kozak
5,586,847 A 12/1996 Mattern, Jr. et al.
5,590,575 A 1/1997 Ludy
5,606,758 A 3/1997 Tung
5,735,005 A 4/1998 Wang
5,765,454 A 6/1998 Barbulescu et al.
5,779,404 A 7/1998 Jore
5,781,963 A 7/1998 Maru et al.
5,894,765 A 4/1999 Anderson et al.
5,911,799 A 6/1999 Johnson et al.
6,055,889 A * 5/2000 Rinner ..... 81/489 X
6,058,812 A 5/2000 Casel et al.

* cited by examiner

HAND TOOL

This Application claims benefit of Provisional No. 60/185,775 filed Feb. 29, 2000.

BACKGROUND OF THE INVENTION

1. Technical Field

The present invention relates generally to a hand held bit driver and, more particularly, to a hand held driver having a torque bar selectively disposable in an operative position or stored position within the driver handle.

2. Discussion

Hand held drivers including a variety of screwdrivers and the like have been generally known in the art for some time. However, due to the general axial alignment of the bit and the handle, it is often difficult for the operator to exert sufficient torque on a workpiece such as a screw.

Some manufacturers have attempted to mitigate this problem by providing the handle with a rear segment that is pivotal between an axially aligned position and a generally traverse position relative to a forward segment of the handle. Other solutions have included providing the handle with a bar that pivots from a stowed position along the handle to an operative position transverse to the handle. While these devices have provided some relief, the need remains for a hand held driver that includes a torque bar that is positionable in an operative position when torque is needed and a stowed position during normal use.

Moreover, it would be desirable to provide a handle configuration that effectively couples the torque bar to the handle as well as a more robust handle configuration capable of accommodating the torque loads. Additionally, it is desirable that the handle design of the hand held driver have an ergonomic shape both in its normal operating mode as well as when the torque generating structure is deployed.

SUMMARY OF THE INVENTION

In view of the above, the present invention is directed to a hand held driver having a torque bar disposable in a stored and operative position relative to the driver handle.

An object of the present invention is to provide a torque bar that is readily accessible to the user as well as easily and efficiently secured in its stored position.

Another object of the present invention is to provide a hand held driver having a strong and durable handle housing that is capable of withstanding the additional torque load to which the driver may be subjected.

Yet another object of the present invention is to provide a hand held driver having the above benefits and further having a bit coupling device that allows for the quick and efficient changing of bits for driving engagement with the handle.

With the above objects in mind, the present invention is generally directed to a hand held tool having a handle chassis and a sleeve fixed to the chassis. The chassis includes a first end, a second end, a bore extending axially between the first and second ends, and a tool passage extending transversely to the bore. The sleeve includes a first end, a second end, a drive aperture extending from the first sleeve end toward the second sleeve end, a storage cavity extending from the second sleeve toward the first sleeve end, and a corridor extending transverse to the storage cavity. A torque bar is connectable to the sleeve in an operative position disposed in the corridor and a stowed position disposed in the storage cavity.

Further areas of applicability of the present invention will become apparent from the detailed description given hereinafter. It should be understood however that the detailed description and specific examples, while indicating preferred embodiments of the invention are intended for purposes of illustration only, since various changes and modifications within the spirit and scope of the invention will become apparent to those skilled in the art from the following detailed description.

BRIEF DESCRIPTION OF THE DRAWINGS

The present invention will become more fully understood from the following detailed description and the accompanying drawings, in which.

DETAILED DESCRIPTION OF THE PREFERRED EMBODIMENT

Figures 1, 2:
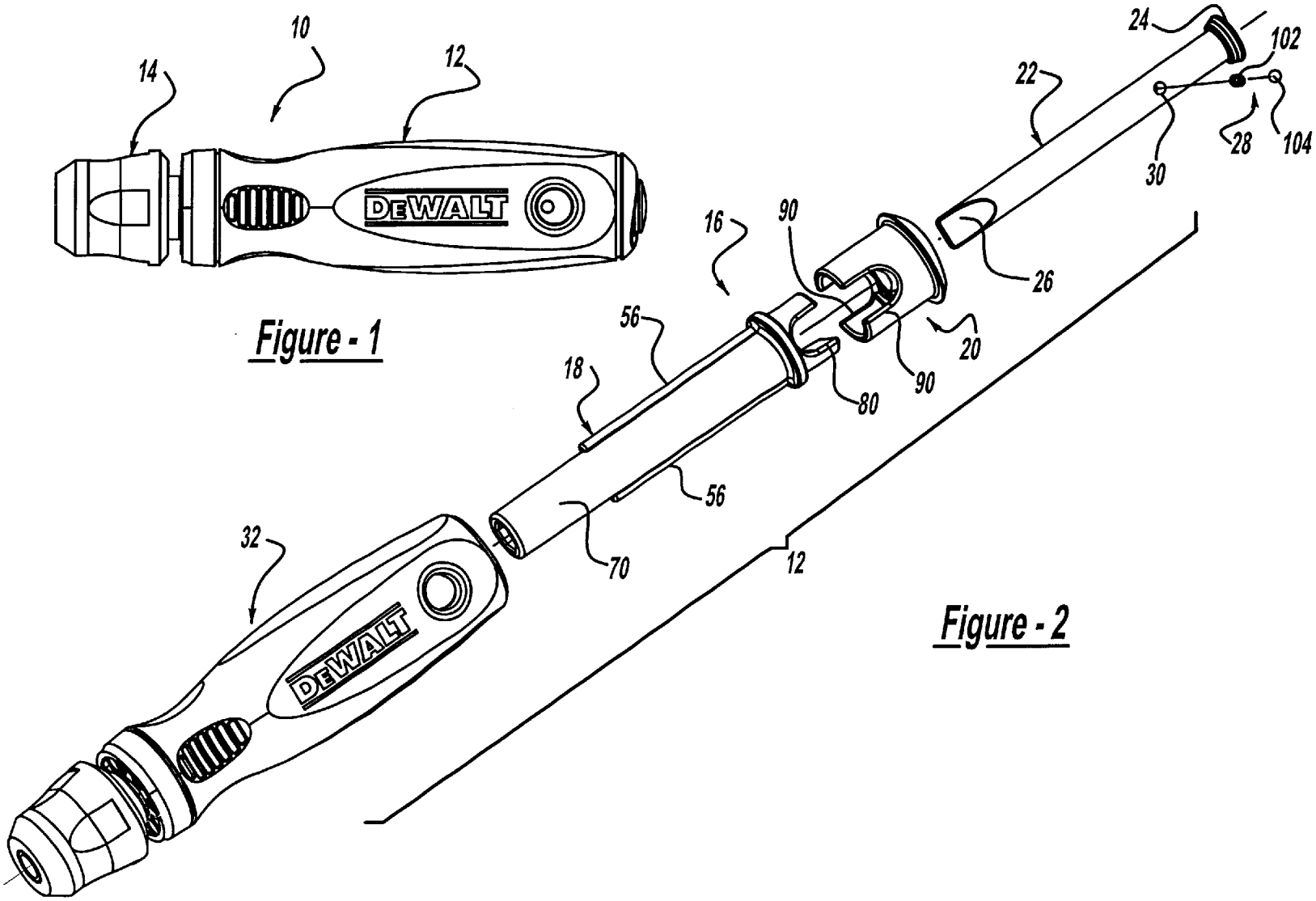
FIG. 1 is a side elevational view of the hand held tool according to the present invention with the torque bar in its stowed position.
FIG. 2 is a partially exploded perspective view of the handle illustrated in FIG. 1.

With reference to the drawings, the hand held driver 10 is illustrated in FIG. 1 to generally include a handle 12 and a bit holder 14. As is described in detail below, the bit holder 14 is coupled for rotation with the handle 12 and is configured to permit the operator to easily and securably connect a variety of bits to the bit holder for driving engagement with the handle 12. A bit holder of the type illustrated herein is more completely described in U.S. patent application Ser. No. 09/105,661, filed Jun. 26, 1998, assigned to the assignee of the present application, and entitled "Quick-Acting Tool Bit Holder", the disclosure of which is incorporated herein by reference. It should be appreciated that the hand held driver 10 may be used without the bit holder 14 wherein the bits are directly connected to driving engagement with the handle 12.

Figure 6:
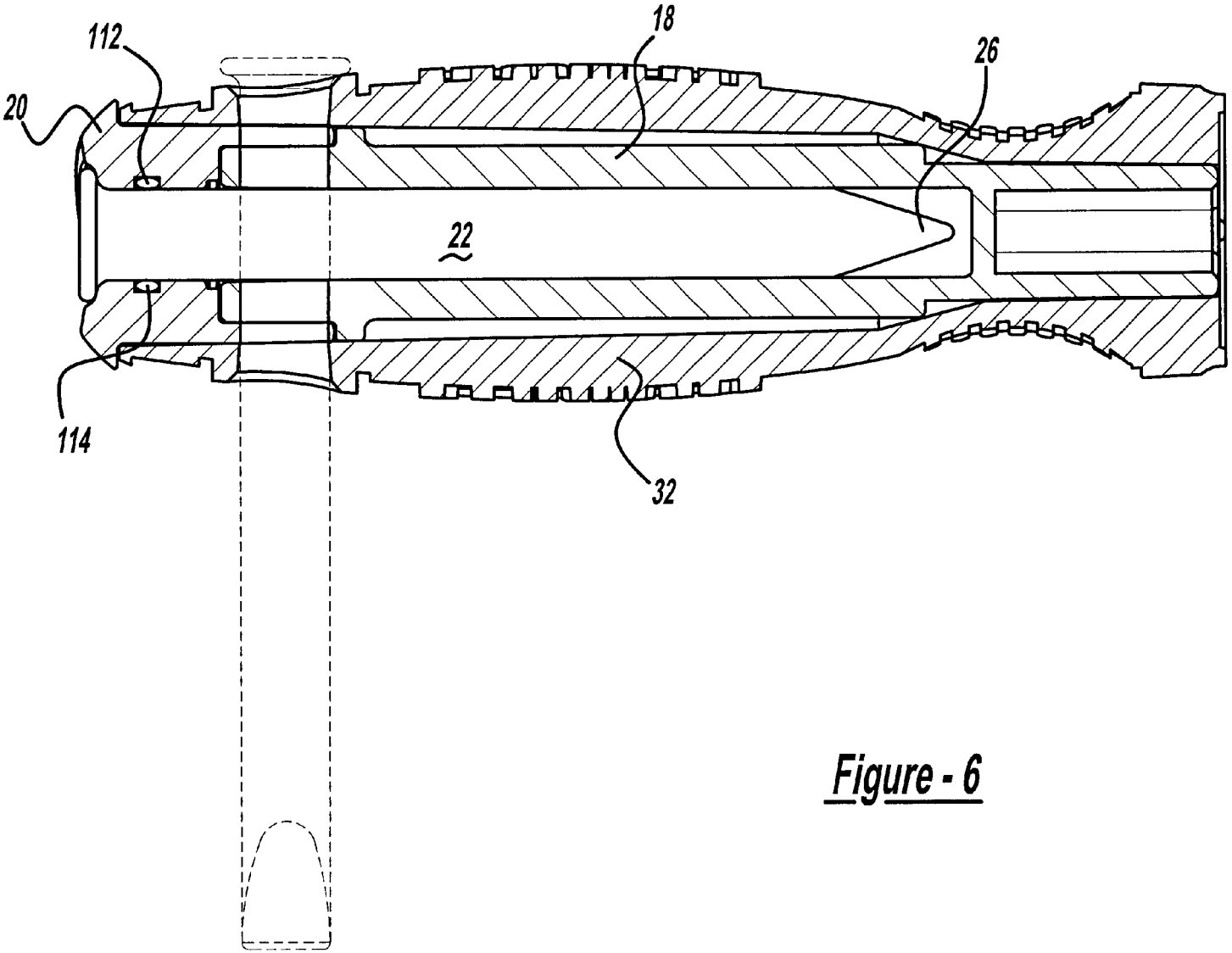
FIG. 6 is a sectional view similar to that shown in FIG. 2 illustrating another embodiment of the hand held tools.

As is best illustrated in FIG. 2, the handle 12 includes a torsion sleeve 16 having a tube segment 18 and a cap 20. A torque bar 22 is selectively positionable relative to the sleeve 16 in one of a stored position illustrated in FIGS. 1 and 3 and an operative or torque generating position illustrated in shadow in FIG. 3. In the illustrated embodiment, the torque bar 22 includes a head 24, a working end 26, and a detent device 28 disposed within a chamber 30 extending radially inward from an outer surface of the torque bar. In the illustrated embodiment, the working end 26 of the torsion shaft is configured as a flat blade to operate as a pry bar or screwdriver as needed. Those skilled in the art will appreciate that the specific configuration of the torque bar 22, including the working end 26, may be varied to provide numerous additional features without departing from the scope of the invention as defined by the appended claims. By way of example, the working end 26 of the shaft is illustrated in FIG. 6 is a punch.

Figure 5:
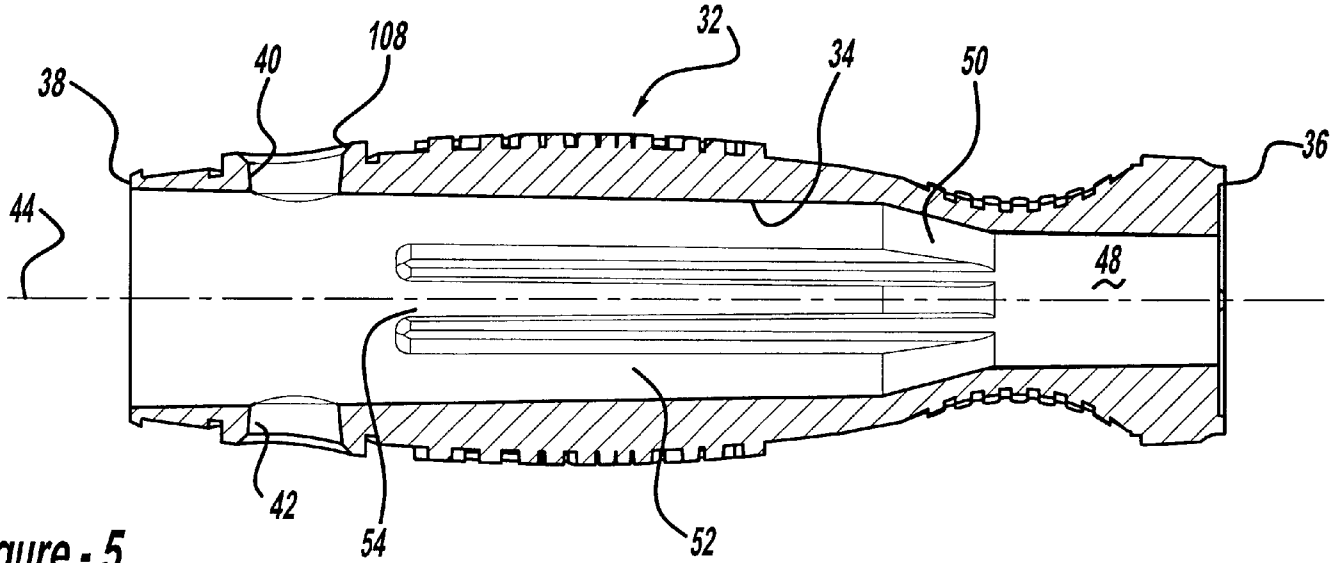
FIG. 5 is a sectional view of the chassis taken along the line 5—5 shown in FIG. 2.

Returning to the configuration of the handle 12, the handle includes a chassis 32 having an axial cavity 34 (FIG. 5) extending from a first end 36 to a second end 38 thereof. The chassis 32 is preferably manufactured by molding a rigid plastic in order to provide a structure capable of maintaining the torsion sleeve 16 fixed for rotation with the chassis 34 as well as assist in bearing the stresses during operation of the tool. The chassis 32 further includes opposed radial apertures 40 and 42 that are aligned to define a passage transverse to the chassis axis 44. The cavity 34 includes a cylinder front section 48 extending rearwardly from the first chassis end 36 to an intermediate conical transition 50. A generally cylindrical rear section 52 extends from transition 50 to the second chassis end 38. A pair of diametrically opposed grooves 54 are formed in chassis 32 to accommodate opposed longitudinal ribs 56 (FIG. 2) extending along the tube segment 18 of the torsion sleeve 16 to rotationally couple the tube segment to the chassis. Finally, the handle 12 further includes an overmolded sleeve 58 (FIG. 3) that is configured to cooperate with the outer surface of the chassis 32 to define an ergonomic exterior handle surface. The overmolded sleeve is preferably formed of a soft material.

Figure 4:
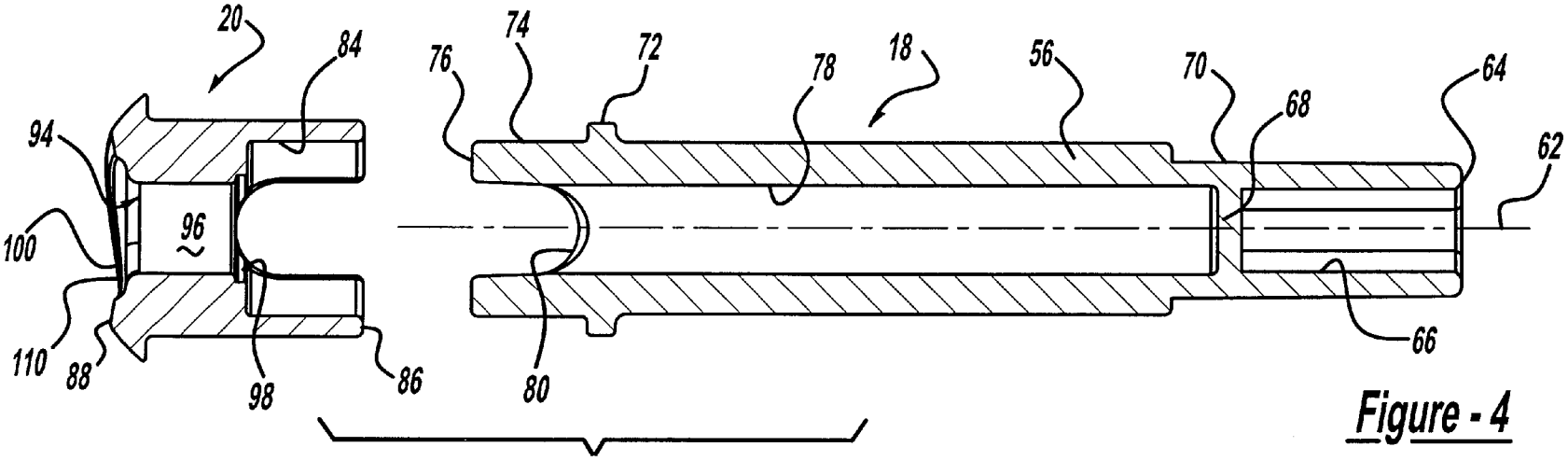
FIG. 4 is a sectional view of the torsion sleeve taken along the line 4—4 shown in FIG. 2.

The configuration of the torsion sleeve 16 will now be described with reference to FIGS. 2 and 4. As noted above, the torsion sleeve 16 includes a tube segment 18 and a cap 20 each of which are preferably manufactured through casting of a high strength metal. The cap 20 is configured to be coupled to the tube 18 when the cap 20 is aligned with the tube axis 62. The tube segment 18 includes a first end 64 having a non-circular drive aperture 66 extending axially inwardly therefrom and terminating at a wall 68. The aperture 66 is configured to drivably receive a similarly configured shank on the bit holder 14. Other than longitudinal ribs 56, the outer surface 70 of the tube segment extends in a generally uniform manner from the first end 64 to a radial flange 72. A coupling segment 74 of the tube sleeve 18 extends from the radial flange 72 to a second tube end 76. The tube sleeve 18 also includes a bore 78 extending from the second end 76 and terminating at wall 68 as well as arch-shaped recesses 80 (FIG. 2) extending between the inner and outer surfaces of the coupling segment 74 and inwardly from the second end 76 (FIG. 4).

The cap 20 includes an enlarged cavity 84 extending axially from a first end 86 toward a second end 88. The enlarged cavity 84 is generally circular in configuration having a diameter size to telescopically accommodate the coupling segment 74 of the sleeve tube 18. Cap 20 also includes opposed recesses 90 that extend from first cap end 86 toward second end 88. When assembled, the first end 86 of the cap is placed in abutting engagement with the radial flange 72 (FIG. 3) and the cap and sleeve are rotationally aligned such that the recesses 80 and 90 align with one another, and with radial chassis apertures 40 and 42, to define a passage that accommodates the torque bar in its operative position shown in shadow in FIG. 3.

Figure 3:
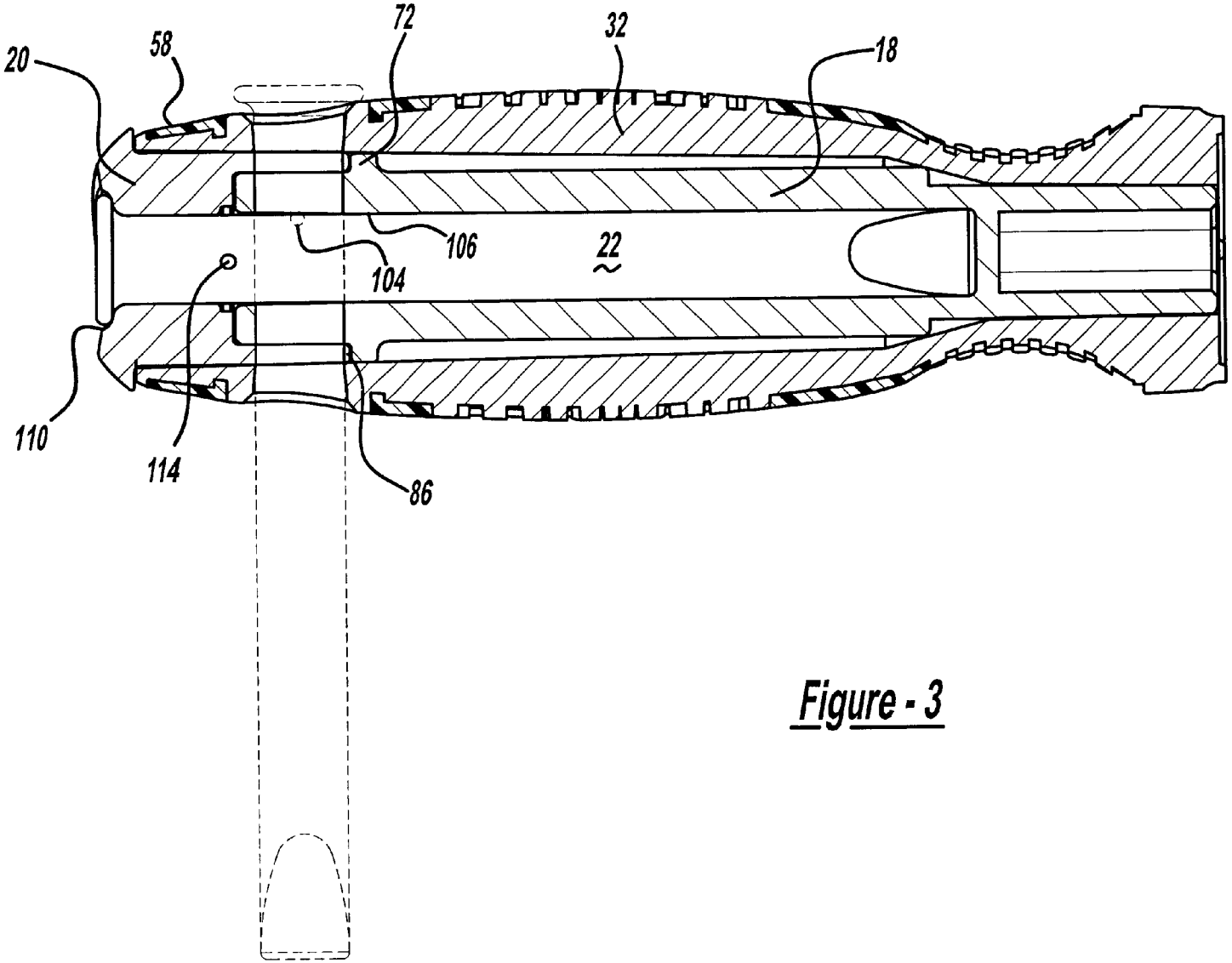
FIG. 3 is a sectional view of the hand held tool illustrated in FIG. 1 taken along the line 3—3.

Cap 20 further includes an opening 94 extending inwardly from second end 88 and communicating with enlarged cavity 84. Opening 94 includes a center segment 96 which has a diameter substantially equal to the diameter of bore 78 and which is bounded on inner and outer sides by a detent catch groove 98 and a head entrance 100, respectively. The opening 94 and bore 78 combine to form a storage cavity within the torsion sleeve 16 that accommodates the torque bar 22 in its stowed position as shown in FIG. 3. In its stowed position, the torque bar 22 is generally axially aligned with the chassis axis 44 and the sleeve axis 62. Further, the detent assembly 28, releasably engages the catch groove 98 formed in the cap 20 to releasably connect the torque bar 22 to the sleeve 18 when the torque bar is in its stowed position.

As is illustrated in FIG. 2, one embodiment of the detent assembly 28 includes a spring 102 and a ball 104 disposed within chamber 30. The ball 104 is biased by spring 102 into its engaged position wherein a portion of the ball extends beyond the outer surface of the torsion shaft. The engagement of the detent assembly 28 with the catch groove 98 resists inadvertent or unintended removal of the torque bar 22 from its stowed position. However, the detent assembly permits the user to purposefully remove the torque bar from its stowed position for use. Similarly, as shown in shadow in FIG. 3, when the torque bar 22 is in its operative position, the ball 104 engages the inner sleeve surface 106 to releasably retain the torque bar against axial displacement.

The head 24 of the torque bar 22 is configured for cooperative engagement with flared end sections 108 (FIG. 5) provided in radial chassis apertures 40 and head entrance 100 of cap 20 when the shaft is in its operative and stowed positions, respectively. The head entrance 100 is generally configured in the same manner as the head 24 but includes a depression 110 (FIGS. 3 and 4) to allow the operator to grasp the head when the shaft is in its stowed position.

FIG. 6 illustrates an alternative embodiment for the retaining assembly 28 that includes an O-ring 112 disposed within a circumferential groove 114 formed in cap 20. The O-ring is preferably formed of a resilient elastomeric material that frictionally retains the torque bar 22 in its operative position as illustrated in FIG. 6. It should be appreciated that in this embodiment, the detent spring 102, ball 104, and catch groove 98 are eliminated from the shaft and cap, respectively. Accordingly, when the torque bar 22 is disposed in its operative position shown in shadow in FIG. 6, there is no frictional engagement or detent mechanism that retains the torque bar in this operative position.

Figure 7:
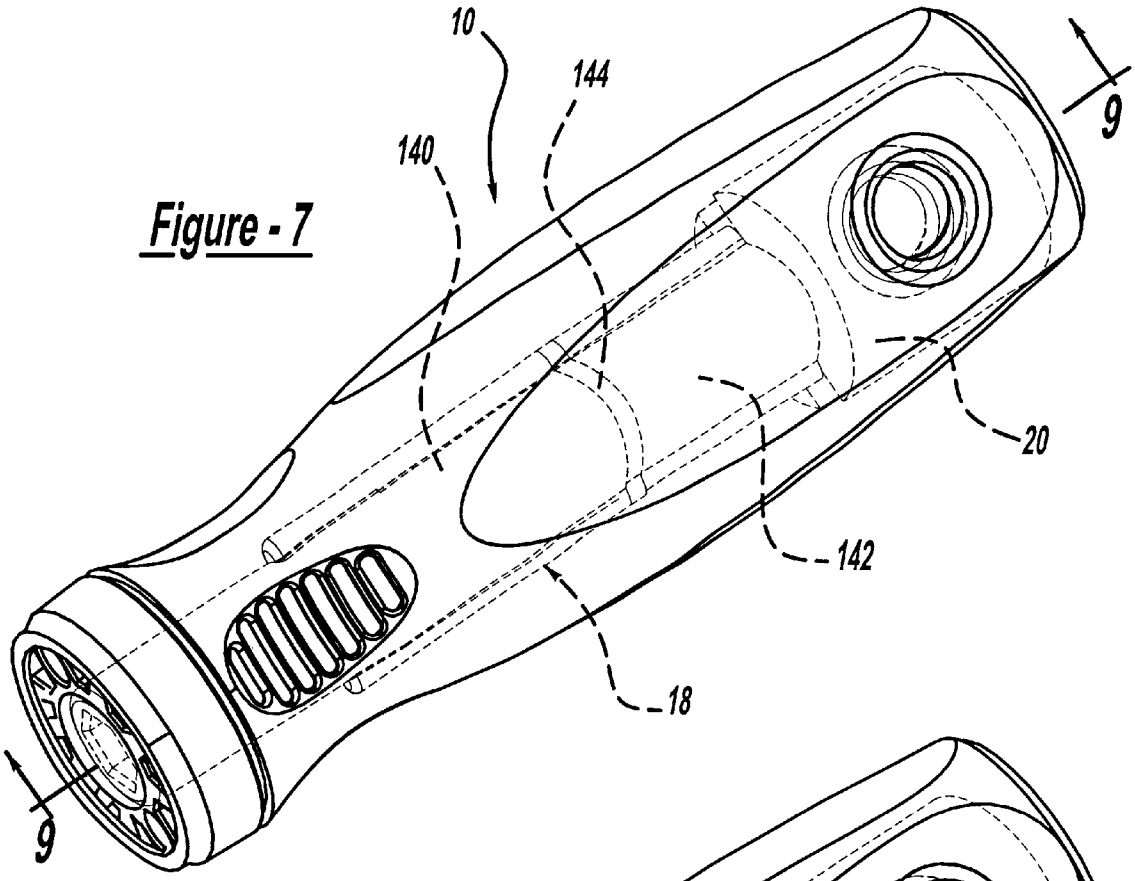
FIG. 7 is a perspective view of the handle according to another embodiment with an insulated sleeve shown in phantom.
Figure 8:
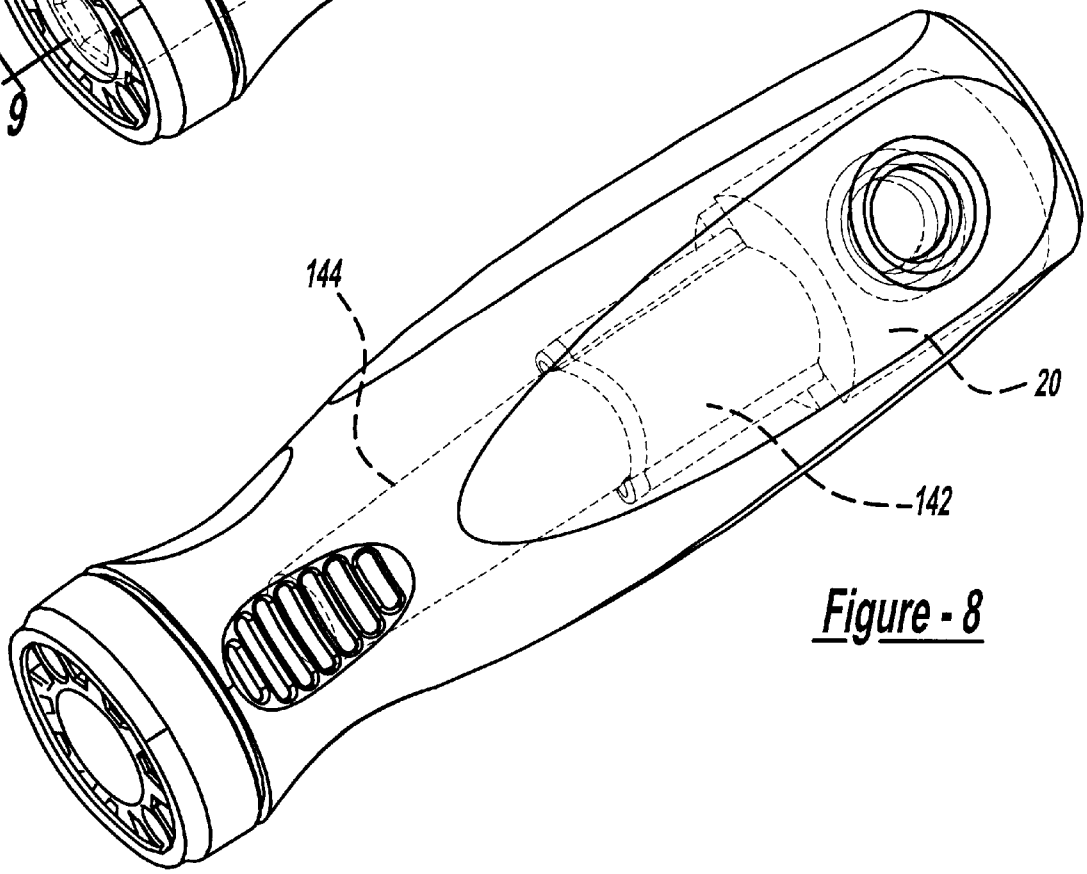
FIG. 8 is a perspective view similar to FIG. 7 with a forward portion of the insulated sleeve removed to show the cone-shaped insulator.
Figure 9:
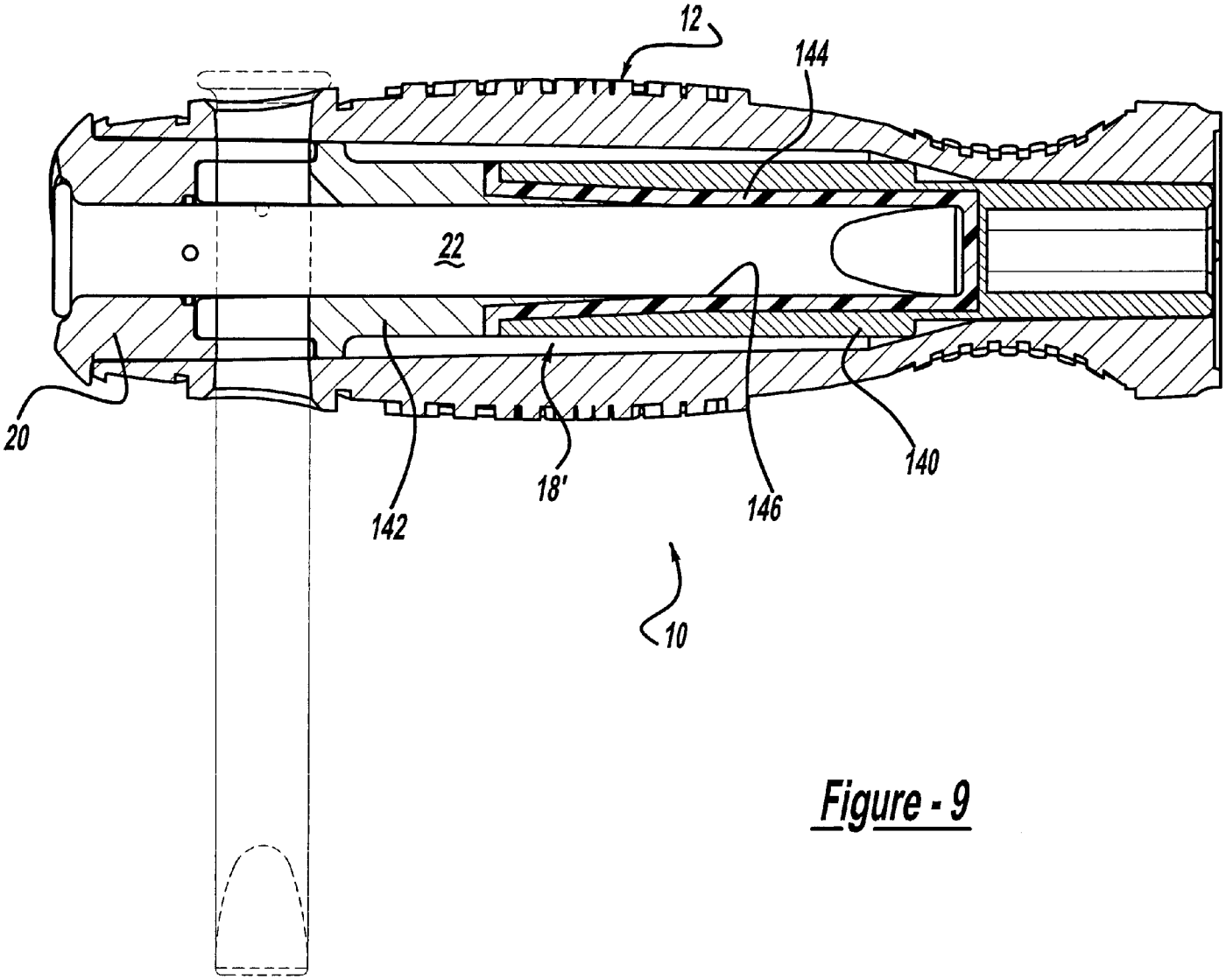
FIG. 9 is a sectional view taken along line 9—9 of FIG. 7.

FIGS. 7–9 illustrate a further embodiment including an insulated handle 12. Specifically, the hand held driver is provided with an insulator wherein the tube 18' is modified to include fore and aft sections 140, 142 each formed of metal, and a non-conductive plastic insulating cone 144. The insulating cone 144 separates the fore and aft sections 140, 142 to prevent communication of current through the handle 12. The cone 144 has an inner surface 146 that is configured to receive the torsion shaft 22. Thus, the torsion shaft 22 is also insulated from transmitting current.

Figure 10:
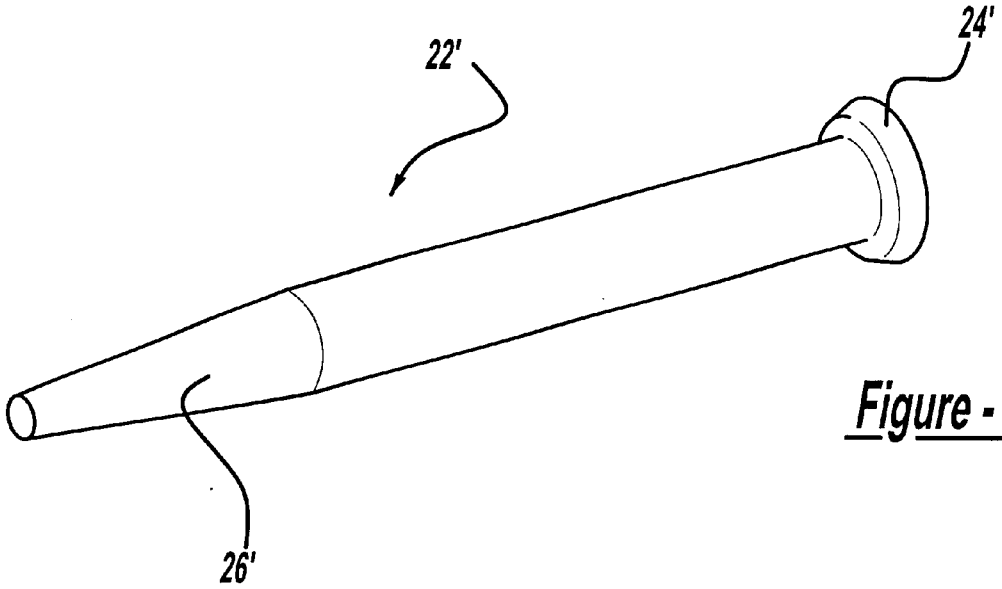
FIG. 10 is a perspective view of a second preferred embodiment of the torque bar.
Figure 11:
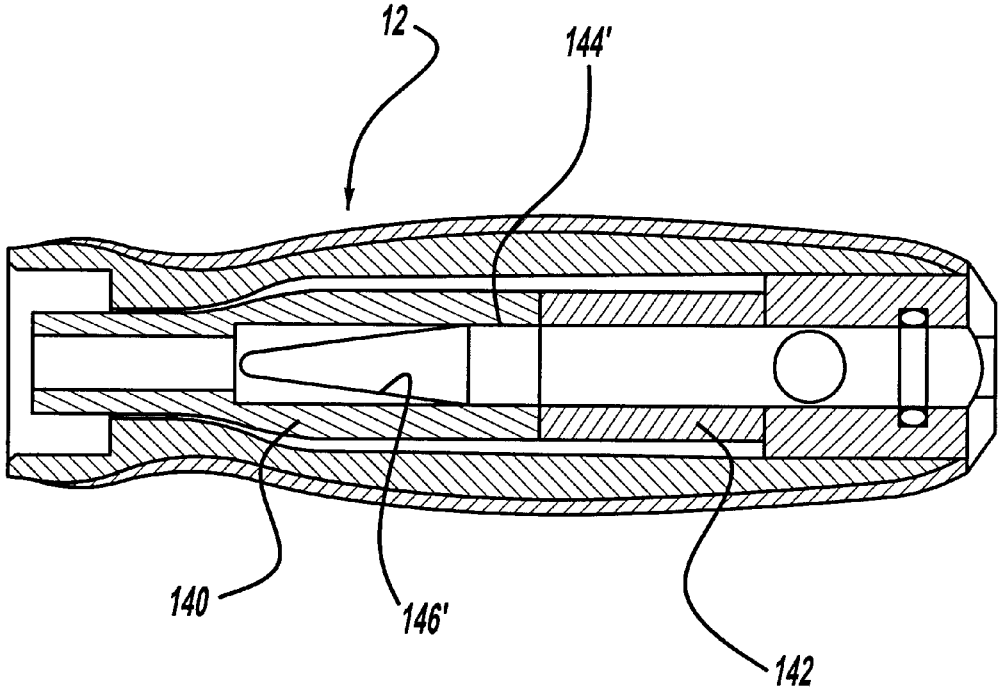
FIG. 11 is a sectional view detailing a second preferred embodiment of the cone shaped insulator.

FIGS. 10 and 11 illustrate a second preferred embodiment of a torque bar 22' and an insulator cone 144'. The torque bar 22' includes a head 24' and a working end 26'. The working end 26' is configured as a conical punch. The insulating cone 144' has a formed inner surface 146' for receiving the torque bar 22'. The hand held driver 10 is assembled and operated exactly as described previously when implementing the torque bar 22' and insulating cone 144'.

From the above description, it should be appreciated that the hand held driver 10 of the present invention is configured to allow an operator of the driver to dispose the torque bar 22 in its stowed or operative position. The torsion sleeve 16 and chassis 34 are configured to accommodate the torque bar in the two positions as well as to provide an overall structural configuration capable of withstanding the anticipated stresses generated when the torque bar is in its operative position.

The invention being thus described, it will be obvious that the same may be varied in many ways. Such variations are not to be regarded as a departure from the spirit and scope of the invention, and all such modifications as would be within the knowledge of one skilled in the art are intended to be included within the scope of the following claims.

What is claimed is:

1. A hand held tool comprising:

a handle having a chassis and a sleeve, said chassis including a first end, a second end, and a cavity extending axially between said first and second ends said sleeve non-removably mounted in said cavity and fixed for rotation with said chassis, said sleeve having a first sleeve end, a second sleeve end, a drive aperture extending from said first sleeve end toward said second sleeve end, and a bore extending from said second sleeve end toward said first sleeve end, said chassis and sleeve defining a passage extending through said handle transverse to said bore; and a torque bar connectable to said sleeve in an operative position and a stowed position, said torque bar disposed in said passage when said torque bar is in its operative position, said torque bar disposed in said bore when said torque bar is in its stowed position.

2. The tool of claim 1 wherein said sleeve includes a rail extending along and outwardly from an outer cylindrical surface of said sleeve, wherein said chassis includes an axial groove extending from said cavity, and wherein said rail is disposed in said groove to couple the sleeve for rotation with said chassis.

3. A hand held tool comprising:

a handle having a chassis and a sleeve, said chassis including a first end, a second end, and a cavity extending axially between said first and second ends said sleeve disposed in said cavity and fixed for rotation with said chassis, said sleeve having a first sleeve end, a second sleeve end, a drive aperture extending from said first sleeve end toward said second sleeve end, and a bore extending from said second sleeve end toward said first sleeve end, said chassis and sleeve defining a passage extending through said handle transverse to said bore;

a torque bar connectable to said sleeve in an operative position and a stowed position, said torque bar disposed in said passage when said torque bar is in its operative position, said torque bar disposed in said bore when said torque bar is in its stowed position; and further including a retaining assembly coupling said bar to said sleeve when said torque bar is in said stowed position.

4. The tool of claim 3 wherein said retaining assembly includes a resilient O-ring coupled to said sleeve and extending into said bore.

5. The tool of claim 3 wherein said retaining assembly includes a chamber formed in said torque bar, a ball movable in said chamber between an engaged position and a disengaged position, and a spring urging said ball toward said engaged position.

6. The tool of claim 3 wherein said retaining assembly further couples said torque bar to said sleeve when said torque bar is in said operative position.

7. The tool of claim 6 wherein said retaining assembly includes a chamber formed in said torque bar, a ball movable in said chamber between an engaged position and a disengaged position, and a spring urging said ball toward said engaged position, wherein said sleeve includes a first detent groove and an inner surface defining said bore, wherein said ball engages said first detent groove when said torque bar is in said stowed position, and wherein said ball engages said inner surface when said torque bar is in said operative position.

8. The tool of claim 1 wherein said sleeve includes a tube and a cap, said cap and tube each including a pair of recesses, said recesses in said tube being aligned with said recesses in said cap to partially define said passage.

9. The tool of claim 8 wherein said chassis includes radial apertures aligned with said recesses to define said passage.

10. The tool of claim 8 wherein said second sleeve end is disposed in said cap so as to align said recesses of said sleeve with said recesses in said cap.

11. The tool of claim 1 wherein said sleeve includes a wall separating said drive aperture from said bore.

12. The tool of claim 1 wherein said drive aperture has a non-circular cross-section.

13. A hand held tool comprising:

a handle having a chassis and a sleeve, said chassis including a first end, a as second end, and a cavity extending axially between said first and second ends said sleeve disposed in said cavity and fixed for rotation with said chassis, said sleeve having a first sleeve end, a second sleeve end, a drive aperture extending from said first sleeve end toward said second sleeve end, and a bore extending from said second sleeve end toward said first sleeve end, said chassis and sleeve defining a passage extending through said handle transverse to said bore;

a torque bar connectable to said sleeve in an operative position and a stowed position, said torque bar disposed in said passage when said torque bar is in its operative position, said torque bar disposed in said bore when said torque bar is in its stowed position;

further including a retaining assembly coupling said bar to said sleeve when said torque bar is in said stowed position; and wherein said sleeve includes a first and second section having an insulating member disposed between said first and second sections.

14. The tool of claim 13, wherein said insulating member is adapted to receive said torque bar therein for isolating said torque bar from a forward one of said first and second sections of said sleeve.

15. The tool of claim 1, wherein said torque bar is in the shape of a punch.

16. The tool of claim 1, wherein said torque bar is in the shape of a pry bar.

17. A handle for a tool comprising:

a chassis having a first end, a second end, and a cavity extending axially between said first and second ends; and a sleeve non-removably mounted in said cavity and fixed for rotation with said chassis, said sleeve having a first sleeve end, a second sleeve end, a drive aperture extending from said first sleeve end toward said second sleeve end, a bore extending from said second sleeve end toward said first sleeve end, said chassis and sleeve defining a passage communicating with and extending transverse to said bore; and wherein said sleeve includes a rail extending along and outwardly from an outer cylindrical surface of said sleeve, wherein said chassis includes an axial groove extending from said cavity, and wherein said rail is disposed in said groove to couple the sleeve for rotation with the chassis.

18. A handle for a tool comprising:

a chassis having a first end, a second end, and a cavity extending axially between said first and second ends; and a sleeve non-removably mounted in said cavity and fixed for rotation with said chassis, said sleeve having a first sleeve end, a second sleeve end, a drive aperture extending from said first sleeve end toward said second sleeve end, a bore extending from said second sleeve end toward said first sleeve end, said chassis and sleeve defining a passage communicating with and extending transverse to said bore; and further including a torque bar disposable in said bore in a stowed position and in said passage in an operative position.

19. The handle of claim 18 further including a retaining assembly adapted to couple the torque bar to the sleeve when the torque bar is disposed in said bore.

20. The handle of claim 19 wherein said retaining assembly includes a O-ring coupled to said sleeve and extending into said bore.

21. A handle for a tool comprising:

a chassis having a first end, a second end, and a cavity extending axially between said first and second ends; and a sleeve non-removably mounted in said cavity and fixed for rotation with said chassis, said sleeve having a first sleeve end, a second sleeve end, a drive aperture extending from said first sleeve end toward said second sleeve end, a bore extending from said second sleeve end toward said first sleeve end, said chassis and sleeve defining a passage communicating with and extending transverse to said bore; and wherein said sleeve includes a tube and a cap, said cap and tube each including a pair of recesses extending from an end face thereof, said recesses in said tube being aligned with said recesses in said cap to partially define said passage.

22. The handle of claim 21 wherein said chassis includes radial apertures aligned with said recesses to define said passage.

23. The handle of claim 21 wherein said second sleeve end is disposed in said cap so as to align said recesses of said sleeve with said recesses in said cap.

24. A handle for a tool comprising:

a chassis having a first end, a second end, and a cavity extending axially between said first and second ends; and a sleeve non-removably mounted in said cavity and fixed for rotation with said chassis, said sleeve having a first sleeve end, a second sleeve end, a drive aperture extending from said first sleeve end toward said second sleeve end, a bore extending from said second sleeve end toward said first sleeve end, said chassis and sleeve defining a passage communicating with and extending transverse to said bore; and wherein said sleeve includes a wall separating said drive aperture and said bore.

25. A handle for a tool comprising:

a chassis having a first end, a second end, and a cavity extending axially between said first and second ends; and a sleeve non-removably mounted in said cavity and fixed for rotation with said chassis, said sleeve having a first sleeve end, a second sleeve end, a drive aperture extending from said first sleeve end toward said second sleeve end, a bore extending from said second sleeve end toward said first sleeve end, said chassis and sleeve defining a passage communicating with and extending transverse to said bore; and wherein said sleeve includes a first and a second section having an insulating member disposed between said first and second sections.

26. The handle of claim 25 further including a torque bar disposable in said bore in a stowed position and in said passage in an operative position, wherein said insulating member is adapted to receive said torque bar therein for insulating said torque bar from a forward one of said first and second sections of said sleeve.

* * * * *